US007658152B2

(12) United States Patent
Brenny et al.

(10) Patent No.: US 7,658,152 B2
(45) Date of Patent: Feb. 9, 2010

(54) TIE PLATE INSERTING MACHINE

(75) Inventors: David M. Brenny, Eagle, WI (US); Jeff Hon, Rochester, WI (US); Frank D. Gall, III, Racine, WI (US)

(73) Assignee: Racine Railroad Products, Inc., Racine, WI (US)

( * ) Notice: Subject to any disclaimer, the term of this patent is extended or adjusted under 35 U.S.C. 154(b) by 339 days.

(21) Appl. No.: 11/381,154

(22) Filed: May 2, 2006

(65) Prior Publication Data

US 2007/0283837 A1 Dec. 13, 2007

(51) Int. Cl.

| | |
|---|---|
| ***E01B 3/00*** | (2006.01) |
| *E01B 29/05* | (2006.01) |
| *E01B 27/17* | (2006.01) |
| *E01B 29/04* | (2006.01) |
| *E01B 29/26* | (2006.01) |
| *E01B 29/24* | (2006.01) |
| *E01B 29/32* | (2006.01) |

(52) U.S. Cl. ..... 104/16; 104/2; 104/7.1; 104/7.2; 104/17.1; 104/17.2

(58) Field of Classification Search ..... 104/2, 104/7.1, 7.2, 16, 17.1, 17.2
See application file for complete search history.

(56) References Cited

U.S. PATENT DOCUMENTS

| | | | | |
|---|---|---|---|---|
| 567,232 | A | | 9/1896 | Greenshield |
| 2,730,962 | A | | 1/1956 | Wright et al. |
| 3,120,195 | A | * | 2/1964 | McWilliams ..... 104/17.1 |
| 3,882,785 | A | | 5/1975 | Rowe |
| 3,943,858 | A | * | 3/1976 | Dieringer et al. ..... 104/16 |
| 4,241,663 | A | | 12/1980 | Lund et al. |
| 4,280,613 | A | | 7/1981 | Stewart |
| 4,691,639 | A | | 9/1987 | Holley |
| 4,907,686 | A | | 3/1990 | Cotic |
| 4,942,822 | A | | 7/1990 | Cotic |
| 4,974,518 | A | | 12/1990 | Cotic et al. |
| 5,067,412 | A | | 11/1991 | Theurer et al. |
| 5,331,899 | A | * | 7/1994 | Holley ..... 104/16 |
| 5,465,667 | A | * | 11/1995 | Hosking et al. ..... 104/17.2 |
| 5,617,795 | A | | 4/1997 | Glomski et al. |
| 5,655,455 | A | * | 8/1997 | Smith ..... 104/16 |
| 5,722,325 | A | | 3/1998 | Glomski et al. |
| 6,158,353 | A | | 12/2000 | Theurer |
| 6,595,140 | B1 | | 7/2003 | Madison et al. |
| 2007/0199473 | A1 | * | 8/2007 | Fuerst et al. ..... 104/16 |

* cited by examiner

*Primary Examiner*—S. Joseph Morano
*Assistant Examiner*—Daniel V Venne
(74) *Attorney, Agent, or Firm*—Boyle Fredrickson, S.C.

(57) ABSTRACT

A track mounted machine is capable of inserting a previously positioned tie plate between a rail and underlying cross tie of a railway. The machine preferably is also capable of lifting the rail from the tie prior to tie plate insertion and/or, is capable of operating on both rails of a railway simultaneously. The preferred embodiment includes two tie plate inserter assemblies mounted on a common workhead. Each tie plate inserter assembly includes a pusher that can be moved, under control of an operator stationed on the machine, vertically and longitudinally on the rails so as to be aligned with a field end of the tie plate. The pusher can then be actuated to push the tie plate laterally under the rail.

26 Claims, 12 Drawing Sheets

TIE PLATE INSERTING MACHINE

BACKGROUND OF THE INVENTION

1. Field of the Invention

The invention relates to rail maintenance equipment and, more particularly, relates to a tie plate inserting machine for inserting a previously positioned tie plate between a rail and a tie. It additionally relates to a method of inserting a previously positioned tie plate between a rail and a tie.

2. Discussion of the Related Art

Tie plates are widely used in railway installations. Specifically, the rails of a railroad track are usually secured to cross ties by spikes driven through tie plates positioned between the rail and the tie. The heads of the spikes overlap the base of the rail, and the tie plates block the rails from lateral movement.

It is often necessary during railway track maintenance and/or construction operations to insert a tie plate beneath the rail. For instance, in a typical tie replacement operation, the spikes are pulled from the tie plates to release the tie from the opposed rails. A machine then pulls the tie out from beneath the rails, knocking the tie plates loose as the tie is withdrawn. A laborer then retrieves the tie plates with a hook and sets them aside. Another machine then inserts a new tie beneath the lifted rails. One or two operators then reinsert the tie plates on the top surface of the tie. The tie plates are then inserted between the tie and the rails, either manually or using a machine. The rails are then lowered onto the tie plate, and new spikes are driven through the tie plates to anchor the rails to the tie.

Prior manual and machine based tie plate insertion techniques exhibit marked disadvantages.

In traditional manual-based tie plate insertion techniques, a winch or some other device is used to lift the rail from the tie sufficiently to provide clearance for a tie plate. Operators then place the tie plate on the tie adjacent the rails and push the tie plates beneath the rails, sometimes using a tool. Such manually operated tools are disclosed in U.S. Pat. Nos. 3,882,785 to Rowe and 6,595,140 to Madison et al. Inserting tie plates using such tools is very labor intensive, adding significantly to the cost of a tie replacement operation. It is also very time consuming—undesirably increasing the time that a railway is out of service for track maintenance operations.

Other machines have been proposed that position and insert tie plates, either in a stand-alone basis or as part of a larger machine that performs other track maintenance operations. These machines are disclosed, for example, in U.S. Pat. Nos. 5,067,412 to Theurer et al.; 5,655,455 to Smith; and 6,158,353 to Theurer. All three of these machines dispense tie plates from a magazine, position the tie plate adjacent the rail, and drive the tie plate beneath the rail using a complex structure. These machines are very complex and expensive to operate. They also have reliability issues resulting from their complexity. They are also relatively slow. Their insertion tools also lack the freedom of movement required to reliably insert a previously positioned tie plate beneath a rail.

The need therefore has arisen to provide a tie plate inserting machine that is relatively simple to operate yet is capable of reliably and rapidly inserting a prepositioned tie plate beneath a rail.

SUMMARY OF THE INVENTION

In accordance with a first aspect of the invention, a tie plate inserting machine is provided that inserts prepositioned tie plates beneath the rails of a railway. The machine includes a track mounted chassis, a workhead mounted on the chassis, and a tie plate inserter assembly mounted on the workhead. The tie plate inserter assembly includes a pusher that is driven by hydraulic cylinders or other powered actuators to move vertically, longitudinally, and laterally relative to the railway so as to be aligned with the stationary tie plate and to push the tie plate beneath the rail. In a preferred embodiment, the tie plate inserter assembly additionally includes a frame that supports the pusher. The frame is movably mounted on the workhead so that it is movable laterally of the railway. The pusher is able to move on the frame vertically and longitudinally relative to the railway. The pusher preferably includes a push plate that extends longitudinally relative to the railway and that selectively engages a field end of the tie plate and pushes the tie plate under the rail. It may additionally include a clamp that can selectively clamp the sides of the tie plate to accommodate tie plate misalignment or tie tilting. The machine also preferably includes a rail clamp assembly and jack that lift the rail from the tie during the tie plate insertion process. It may also include a mechanism that prevents the tie plate from being pushed too far beneath the rail. That mechanism may comprise a limit switch or other sensor and/or a hard stop that is located on the gauge side of the rail and that serves as a backstop against which the tie plate is driven during the insertion process.

In accordance with another aspect of the invention, a method is provided of inserting a previously positioned tie plate beneath a rail using a tie plate inserting machine. The method includes placing a tie plate on a tie outboard of a field side of the rail, then moving the tie plate inserting machine to a position which a pusher of the machine is located in the vicinity of the tie plate, and then actuating one or more power actuators to align the pusher with the tie plate and push the tie plate beneath the rail. The tie plates typically will be placed on the tie manually prior to the moving step as part of a tie replacement process. The actuating step may comprise actuating a first actuator to drive the pusher longitudinally of the railway to a position to which the pusher is at least generally aligned with the field end of the tie plate, actuating a second actuator to drive the pusher vertically so that the pusher is at least generally aligned with the tie plate, and then actuating a third actuator to drive the tie plate laterally under the rail.

Other aspects and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications could be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which.

DETAILED DESCRIPTION OF THE PREFERRED EMBODIMENTS

As indicated in the Summary portion above, the invention relates to a track mounted machine that is capable of inserting a previously positioned tie plate between a rail and underlying cross tie of a railway. The machine preferably is also capable of lifting the rail from the tie prior to tie plate insertion and/or, is capable of operating on both rails of a railway simultaneously. The preferred embodiment includes two tie plate inserter assemblies mounted on a common workhead. Each tie plate inserter assembly includes a pusher that can be moved, under control of an operator stationed on the machine, vertically and longitudinally of the rails so as to be aligned with a field end of the tie plate. The pusher can then be actuated to push the tie plate laterally under the rail. A variety of machine configurations are capable of operating in this manner. One especially preferred embodiment will now be described.

Figure 1:
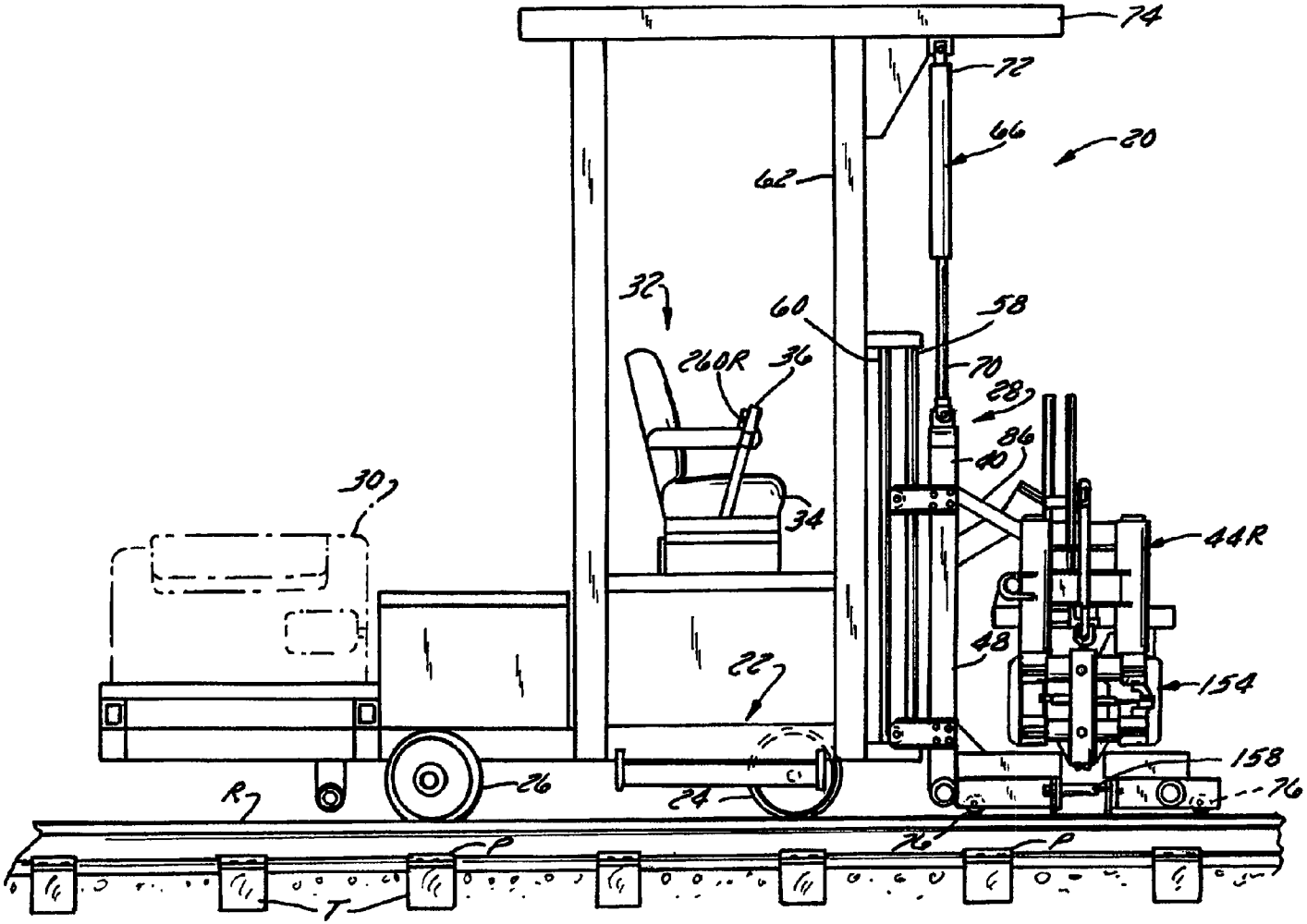
FIG. 1 is a side elevation view of a tie plate inserting machine constructed in accordance with a preferred embodiment of the present invention.
Figure 2:
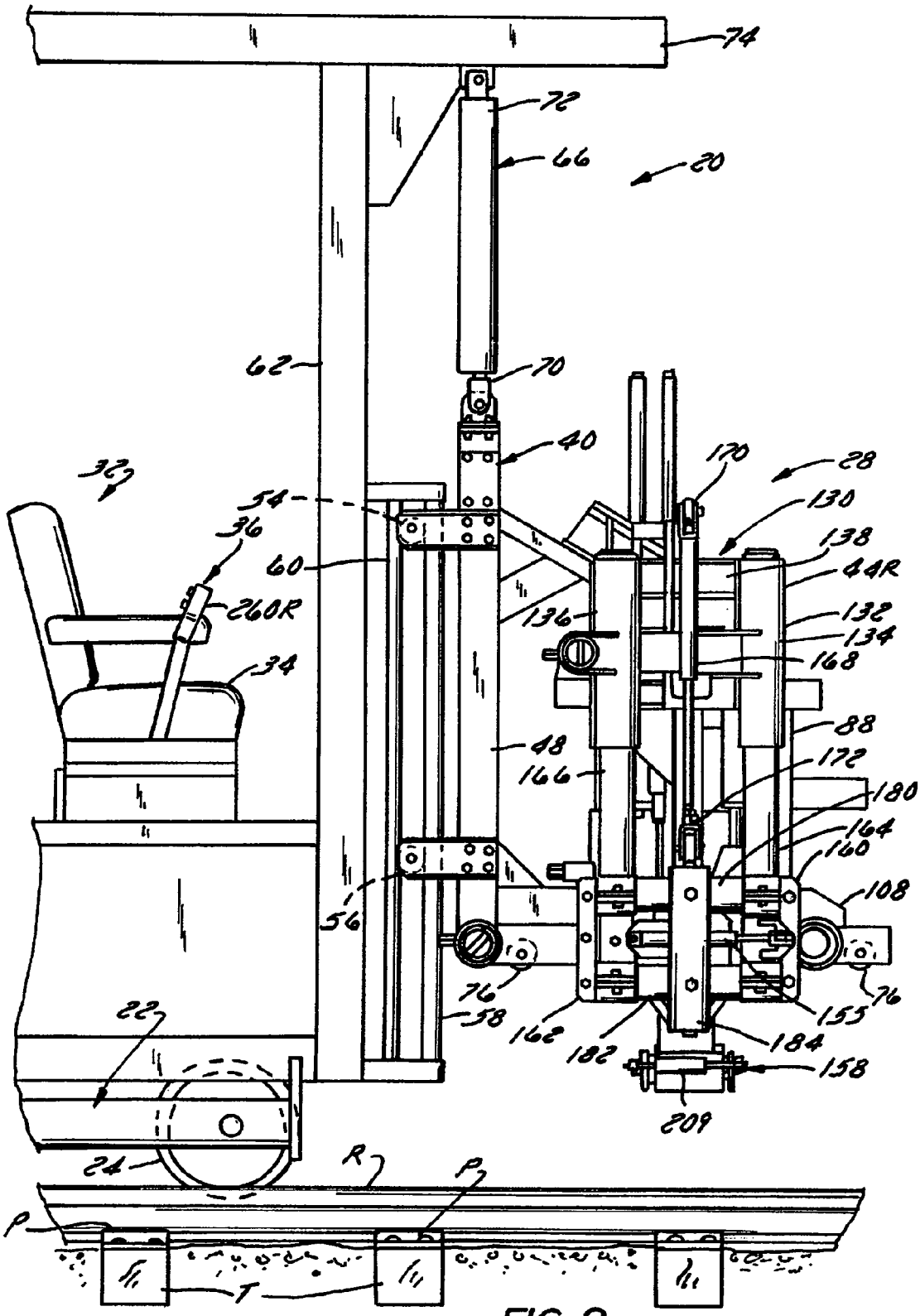
FIG. 2 is a side elevation view of a workhead and the front portion of the tie plate inserting machine of FIG. 1.
Figure 3:
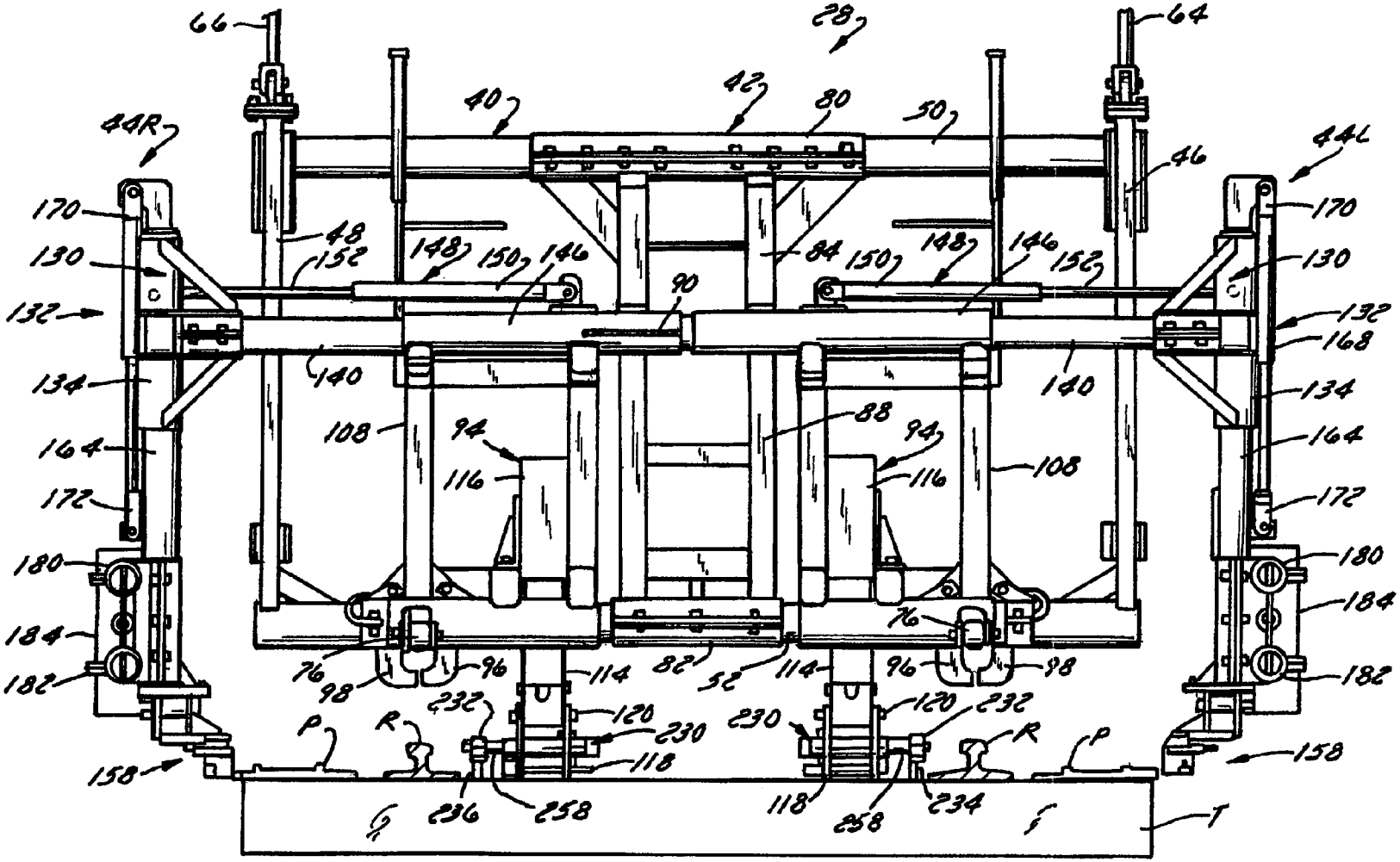
FIG. 3 is a front end view of the workhead of FIGS. 1 and 2.

Referring initially to FIGS. 1-3, a tie plate inserting machine 20 constructed in accordance with the preferred embodiment of the invention includes a chassis 22 that is mounted on the rails R by front and rear wheels 24 and 26 and that supports a workhead 28 at its front end. The chassis 22 is preferably self-propelled by an engine 30 located on the rear of the machine 20. An operator's station 32 is supported on the chassis 22 behind the workhead 28. The operator's station includes a seat 34 and controls 36, detailed below.

The workhead 28 includes a support frame 40, an inserter support carriage 42 mounted on the frame 40 for movement therealong laterally of the rails R, and left and right tie plate inserter assemblies 44L, 44R mounted on the inserter support carriage 42, each of which is operative to insert tie plates P between a tie T and an associated one of the left and right rails R.

The frame 40 includes left and right vertically spaced struts 46, 48 and upper and lower cylindrical support beams 50, 52 affixed to the ends of the struts 46, 48 to form a rectangular structure. The struts 46, 48 are mounted for vertical movement along the chassis by left and right sets of upper and lower roller assemblies 54, 56, each of which is mounted on an associated vertical strut 46, 48 of the frame 40. Each set of roller assemblies 54, 56 rides along a vertical rail 58, 60 on a support frame 62 of the chassis 22. This vertical movement is effected via a pair of hydraulic cylinders 64, 66, each of which has a rod end 70 attached to an associated strut 46, 48 and a barrel end 72 attached to a cantilevered support 74 located above the rails 58, 60. Each cylinder 64, 66 can be selectively extended and retracted to lower the workhead 28 from a raised, transport position to a lowered, operative position. It should be noted that the cylinders 64, 66 are extended during normal use of the machine 20, i.e., as the machine travels from tie to tie, and is raised only when the machine 20 is transported to or from the worksite. When the workhead 28 is lowered by cylinder extension, it is partially supported and guided on the rails R during insertion operations by rollers 76 mounted on the inserter support carriage 42.

Figure 4:
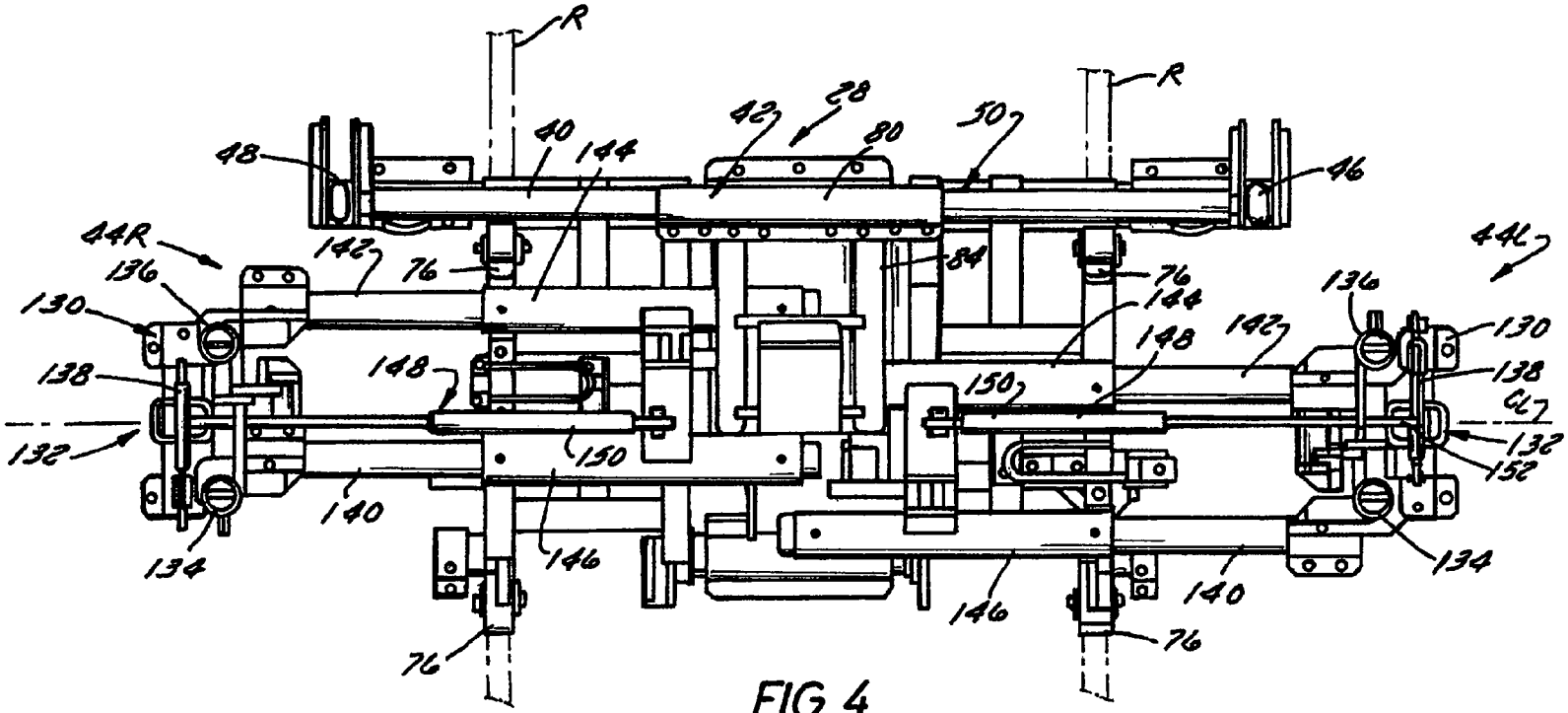
FIG. 4 is a top plan view of the workhead.
Figure 5:
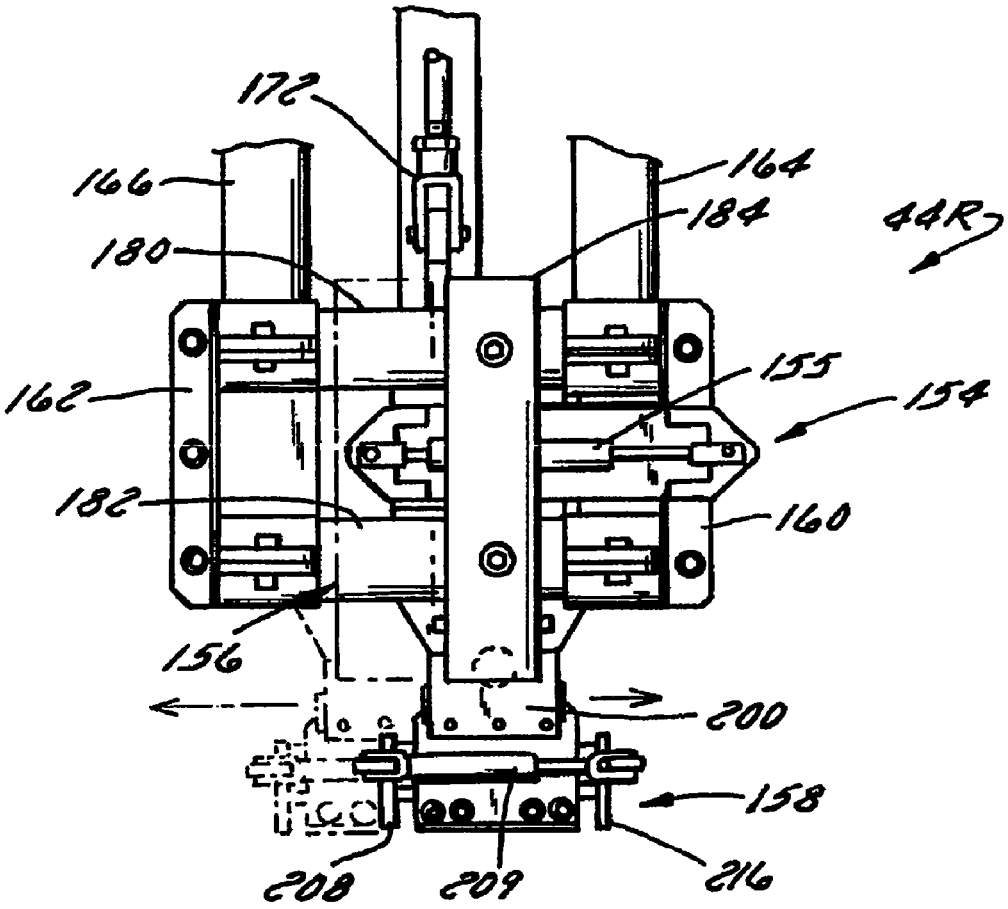
FIG. 5 is a field side elevation view of a tie plate inserter assembly of the workhead.

As best seen in FIGS. 3 and 4, the inserter support carriage 42 is mounted on the beams 50 and 52 by upper and lower sleeves 80, 82. Upper and lower frame assemblies 84, 108 extend forwardly from the sleeves 80, 82 and are affixed to one another by a framework 88.

Each side of the workhead 28 preferably incorporates mechanisms to lift the rail R from the tie T during a tie plate insertion operation. Referring to FIGS. 1-3, and 6-7 these mechanisms preferably each take the form of a rail clamp 92 and a jack 94 mounted on opposite sides of the inserter support carriage 42. Both of these structures may be any of the type that are typically used in rail maintenance equipment.

Figure 6:
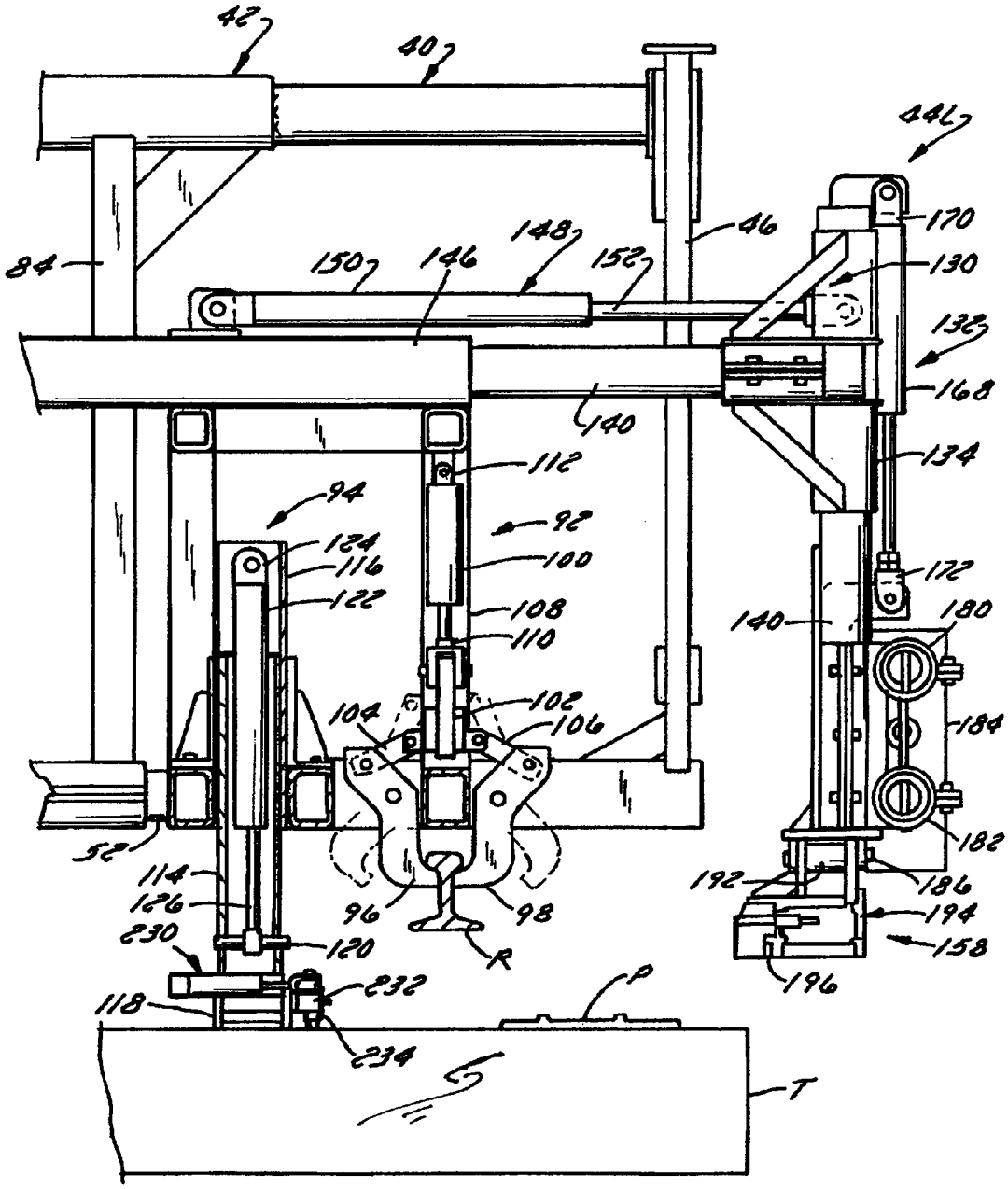
FIGS. 6-9 are a series of rear end elevation views illustrating the use of one of the tie plate inserter assemblies of the tie plate inserting machine to drive a tie plate beneath a rail.
Figure 7:
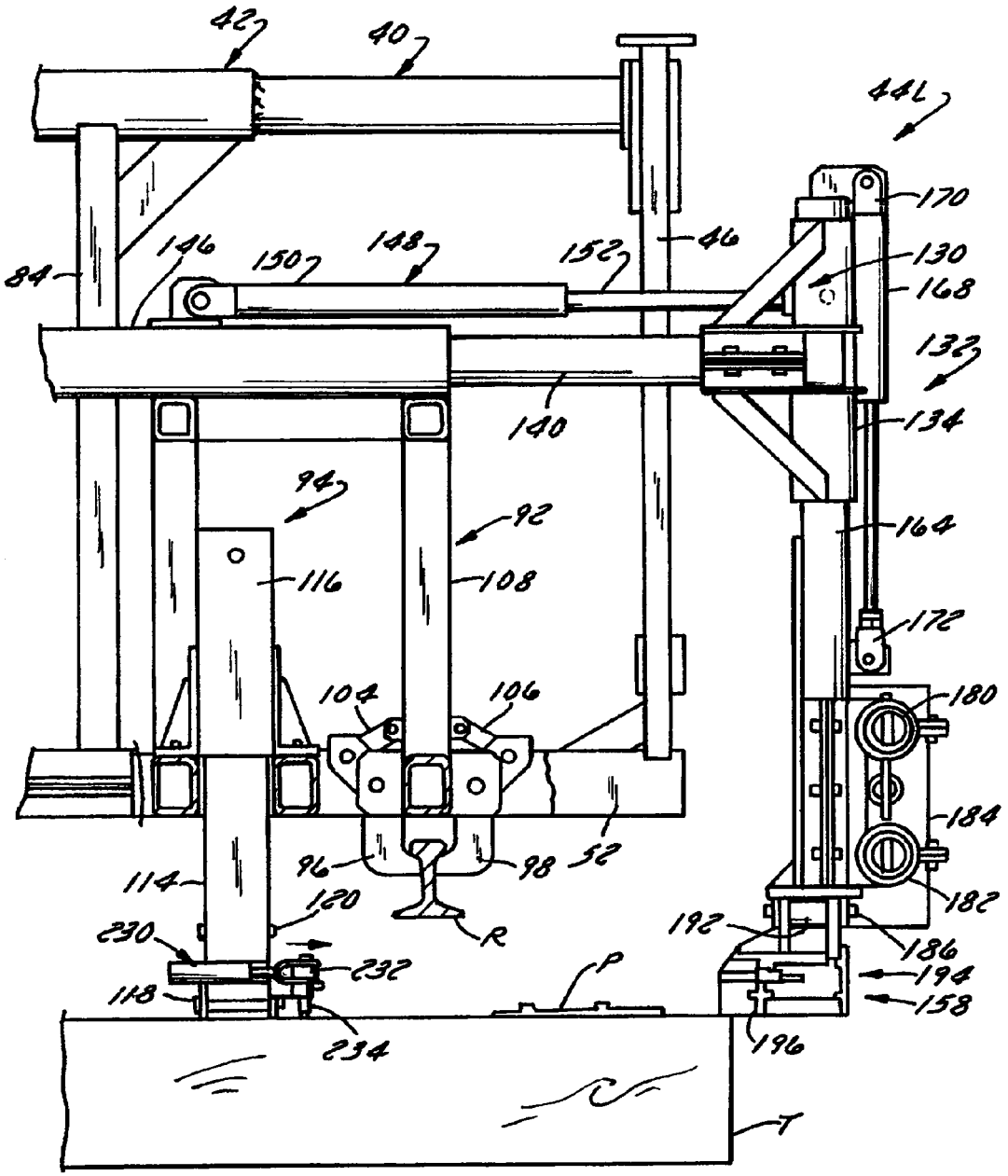
Figure 8:
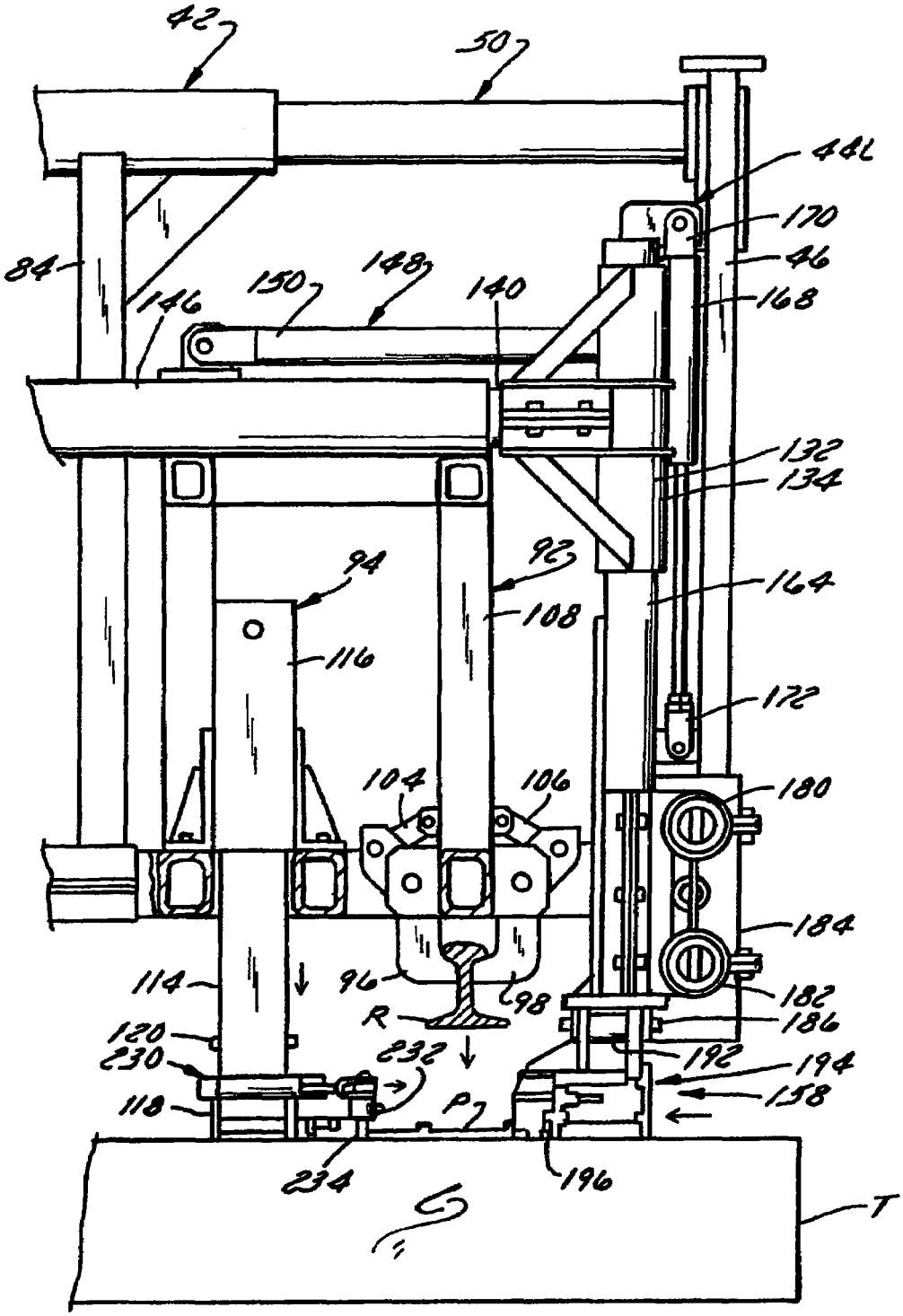

Referring particularly to FIG. 6, the rail clamp 92 of this embodiment includes a pair of pivoting jaws 96, 98 that are operated by a hydraulic cylinder 100 to swing from a disengaged position as seen in phantom lines to an engaged position as seen in solid lines. Each of the jaws 96, 98 is pivotally mounted on the lower frame assembly 108 and is connected to a slide 102 at its upper end by a link 104, 106. The slide 102 is mounted for vertical movement between tubes of frame assembly 108 so as to open and close the jaws 96, 98 upon vertical movement of slide 102. The cylinder 100 is also located between tubes of frame assembly 108 and has a lower, rod end 110 attached to the slide 102 and an upper, barrel end 112 attached to the upper frame assembly 108.

Figure 9:
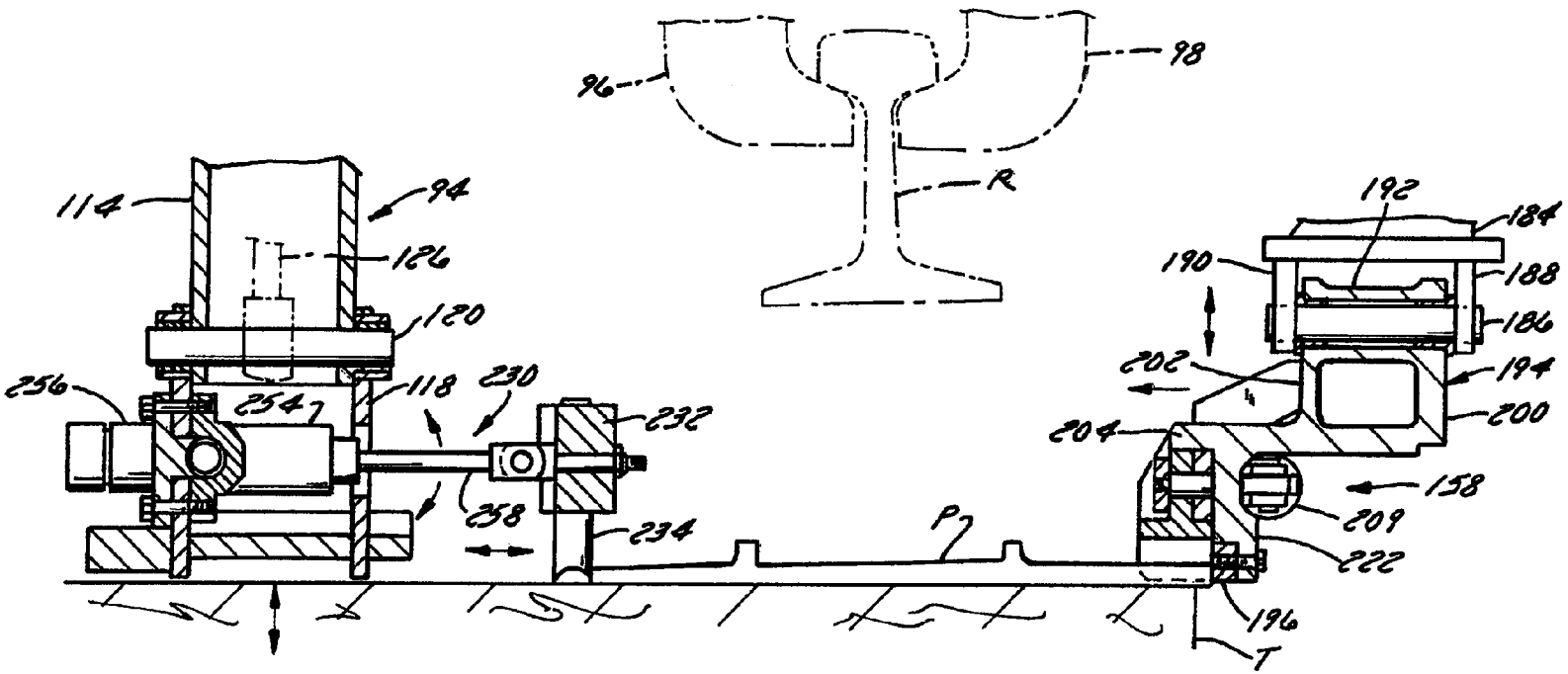
Figure 16:
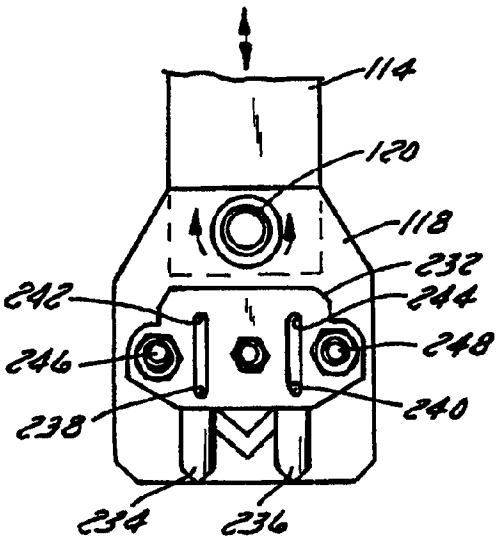
FIGS. 14-16 are top plan, rear elevation, and field side elevation views, respectively, of a backstop of the tie plate inserter assembly of FIGS. 6-9.
Figure 14:
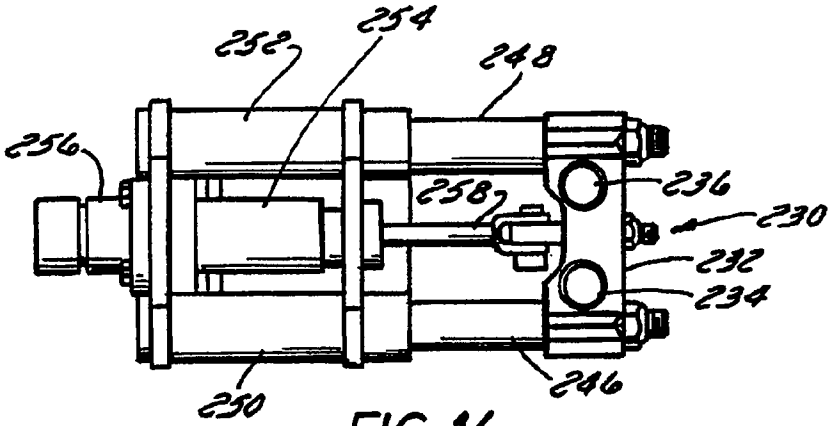
Figure 15:
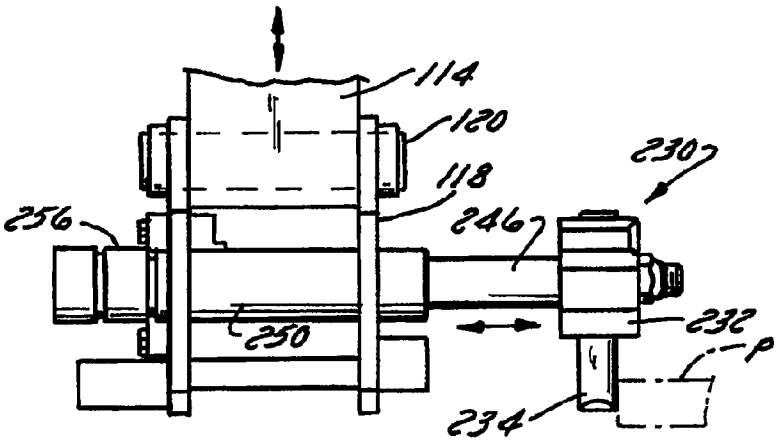

Referring to FIGS. 6-9 and FIG. 6 in particular, the jack 94 preferably comprises a hydraulically operated telescoping jack including a movable inner lift leg 114 and an outer stationary tube 116. The outer tube 116 is affixed to the lower frame assembly 108 of the inserter support carriage 42. The bottom end of the lift leg 114 terminates in a foot 118 that is pivotally attached to the leg by a pivot pin 120 as best seen in FIGS. 9, 15, and 16 so as to accommodate limited tilting of the tie T. The foot 118 has a hollow interior so as to receive the supports for a hard stop 230, described below. Referring again to FIG. 6, a hydraulic cylinder 122 is positioned within the tube 116 and has an upper, barrel end 124 attached to the tube 116 and a lower, rod end 126 attached to the lift leg 114. Extension or retraction of the cylinder 122 telescopes the lift leg 114 downwardly from the tube 116 to first engage the tie T and thereafter lift the rail R from the tie T.

The left and right tie plate inserter assemblies 44L, 44R are preferably of identical construction. As best seen in FIG. 4, they are mounted on the workhead 28 in a mirror image fashion such that the centers of the pushers 158 of the tie plate inserter assemblies 44L, 44R are bisected by a common laterally extending center line CL. Since each of the tie pate inserter assemblies 44L, 44R is identical in operation and construction, only the right assembly 44R will be described, it being understood that the description applies equally to the left assembly 44L.

Referring to FIGS. 2-4, the right tie plate inserter assembly 44R includes a frame 130 mounted on the lower frame assembly 108 for lateral movement relative to the rails R and a pusher assembly 132 mounted on the frame 130. The frame 130 includes front and rear vertically extending support tubes 134, 136 mounted on a weldment 138. The weldment 138 is mounted on front and rear horizontal rods 140, 142. Each of the rods 140, 142 is telescopically received in an associated horizontally extending support tube 144, 146 fixed to the lower frame assembly 108. This telescoping motion is affected by a cylinder 148 that is connected to the lower frame assembly 108 at its inner, barrel end 150 and to an upper tube of a pusher assembly 132 (detailed below) at its outer, rod end 152. Extension or retraction of cylinder 148 drives the pusher assembly 132 laterally toward or away from the rail R.

Referring to FIGS. 2-5, the pusher assembly 132 comprises a vertically movable first carriage 154, a second carriage 156 that is horizontally movable relative to the first carriage 154 longitudinally of the rail R, and a pusher 158 mounted on the second carriage 156. The first carriage 154 includes front and rear vertical supports 160, 162 linked to one another by upper and lower rods (not shown). The upper ends of the supports 160, 162 are mounted on the lower ends of front and rear vertically extending, longitudinally spaced rods 164, 166, the upper ends of which are telescopically received in guide tubes 134, 136 of frame 130. The first carriage 154 is driven for vertical movement relative to the guide tubes 134, 136 by a vertically extending hydraulic cylinder 168 connected to the weldment 138 at its upper, barrel end 170, and to the first carriage 154 at its lower, rod end 172.

Still referring to FIGS. 2-5, the second carriage 156 comprises upper end lower tubes 180, 182 slidably mounted on longitudinally extending rods (not shown) of the first carriage 154. It is driven along the rod by a cylinder 155. It additionally includes a vertically extending mounting tube 184 mounted on the tubes 180, 182. The pusher 158 is pivotally mounted on the bottom of the mounting tube 184 by a pivot pin 186 that allows limited swinging movement of the pusher 158 about a horizontal axis extending laterally of the rails R as best seen in FIGS. 10-13. More specifically, pivot pin 186 extends through ear mounts 188, 190 projecting downwardly from the bottom of the mounting tube 184 and through a bearing 192 of the pusher 158. The passive swinging movement provided by pivot pin 186 permits the pusher 158 to accommodate limited tilt of a tie T while still resting flat on top of the tie T.

Figure 13:
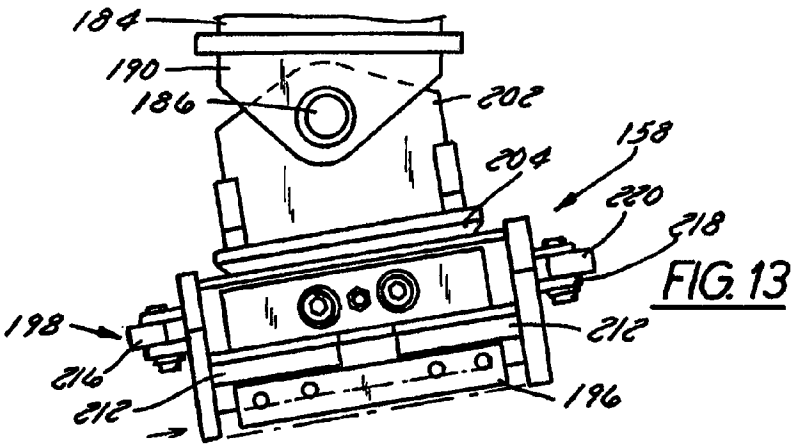
FIG. 13 shows the pusher of FIGS. 10-12 with a clamp assembly of the pusher in a closed position.
Figure 10:
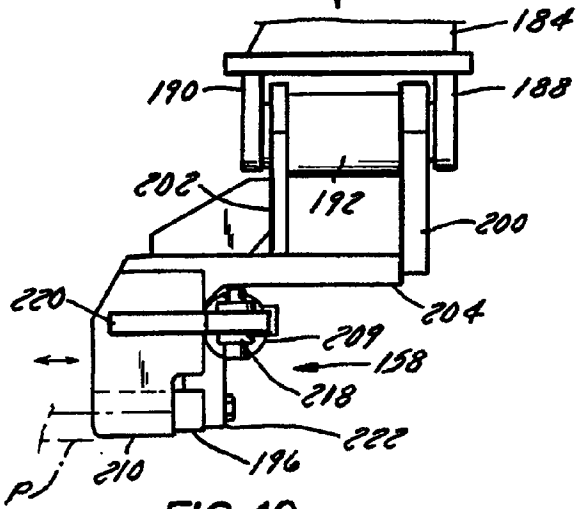
FIGS. 10, 11, and 12 are rear elevation, field side elevation, and gauge side elevation views, respectively, of a pusher of the tie plate inserter assembly of FIGS. 6-9.
Figure 11:
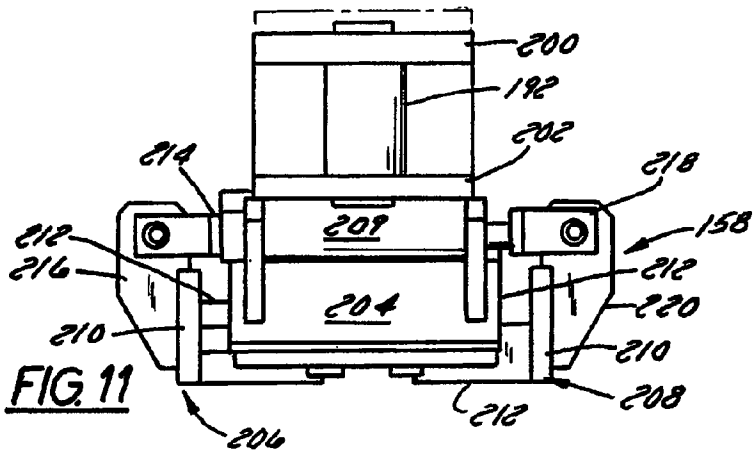
Figure 12:
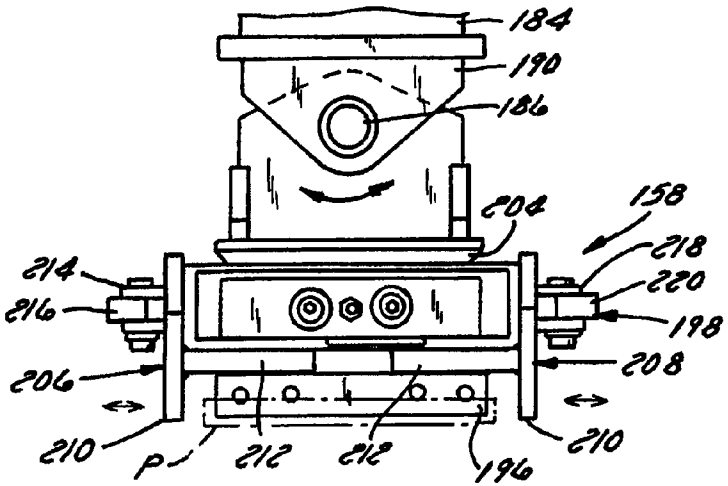

Referring now to FIGS. 9-13, the pusher 158 comprises a support frame 194, a push plate 196, and clamp assembly 198. The frame 194 includes the bearing 192, a pair of vertical plates 200, 202 that extend downwardly from the bearing 192, and a horizontal mounting plate 204 extending laterally inwardly from the vertical plates 200, 202. The clamp assembly 198 comprises first and second generally T-shaped plates 206, 208 coupled to one another by a hydraulic cylinder 209 so as to move toward and away from each other upon cylinder extension or retraction as seen in FIGS. 12 and 13. More specifically, each of the clamp plates 206, 208 includes a vertical leg 210 and a horizontal leg 212 extending perpendicularly from the approximate center of the vertical leg 210. The horizontal legs 212 overlap each other and are restrained from vertical or longitudinal movement relative to the frame by operation of shoulder bolts extending through elongated slots (not shown) in the horizontal legs 212. The vertical legs 210 terminate at lower ends that are at least generally flush with the bottom of the push plate 196. The cylinder 210 has a barrel end 214 attached to an ear mount 216 affixed to the outer surface of the vertical leg 210 of one of the clamp plates 206 and a rod end 218 attached to an ear mount 220 affixed to the outer surface of the vertical leg 210 of the other clamp plate 208. The push plate 196 is located beneath the horizontal legs 212 of the clamp plates and is bolted to a vertical leg 222 of the frame 194 as best seen in FIG. 9.

It should be noted at this point that the clamp assembly 198 is not in any way critical to the design. Indeed, it often remains open during normal operation. It is generally used only when the tie plate P is skewed on the tie T and/or the tie T is tilted.

The tie plate inserting machine 20 preferably incorporates measures to prevent the pusher 158 from driving a tie plate P too far beneath the rail R. For instance, limit switches or optical sensors could be provided for this purpose. In the preferred embodiment, however, a backstop or "hard stop" is provided. Referring to FIGS. 6, 7, and 14-16, the hard stop 230 is mounted on the foot 118 of the jack 94. The hard stop 230 includes a housing 232 and a pair of tapered pins 234, 236 that extend downwardly from the housing 232. The pins 234, 236 are mounted in the housing 232 by horizontal cross pins 238, 240. The cross pins 238, 240 extend through elongated slots 242, 244 in the housing 232, hence allowing the pins 234, 236 to float vertically relative to the housing 232 to prevent damage to the pins 234, 236 should they encounter ballast or the like when the jack 94 engages the tie T. The position of the housing 232 and, therefore, the hard stop 230 as a whole, is preferably adjustable so as to accommodate different length tie plates P. Towards this end, the housing 232 is mounted on a pair of guide rods 246, 248 that are telescopically received in guide tubes 250, 252 mounted within the foot 118 of the jack 94. A hydraulic cylinder 254 is disposed between the guide tubes 250, 252 and has a barrel end 256 affixed to the stationary jack foot 118 and a rod end 258 attached to the housing 232. Extension or retraction of the cylinder 254 moves the housing 232 toward or away from the gauge side of the rail R.

As mentioned briefly above, the tie plate inserting machine 20 is controlled via operator manipulated controls 36 located adjacent the seat 34. These controls include left and right joysticks, the right one 260R of which is seen in FIG. 1. The joysticks are identical in construction and operation with each being operable to control one of the tie plate inserter assemblies 44L, 44R. The right joystick 260R will now be described, it being understood that the discussion applies equally to the left joystick, with the controls on the left joystick 260L being arranged in a mirror image fashion relative to the controls on the right joystick 260R.

Figure 18:
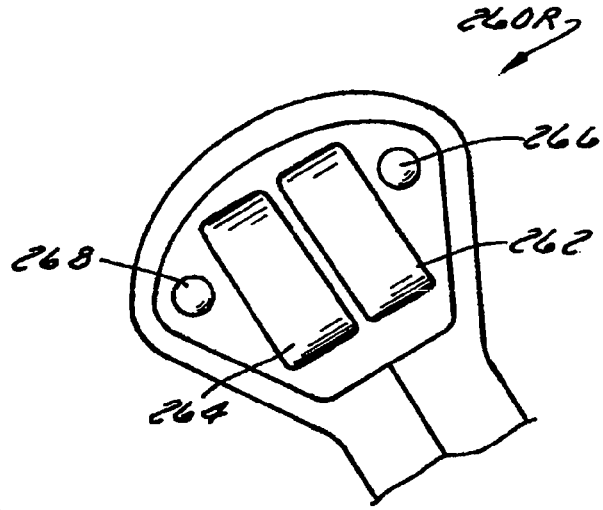
FIGS. 17 and 18 are side elevation and front plan views, respectively, of a portion of a joystick of the tie plate inserting machine.
Figure 17:
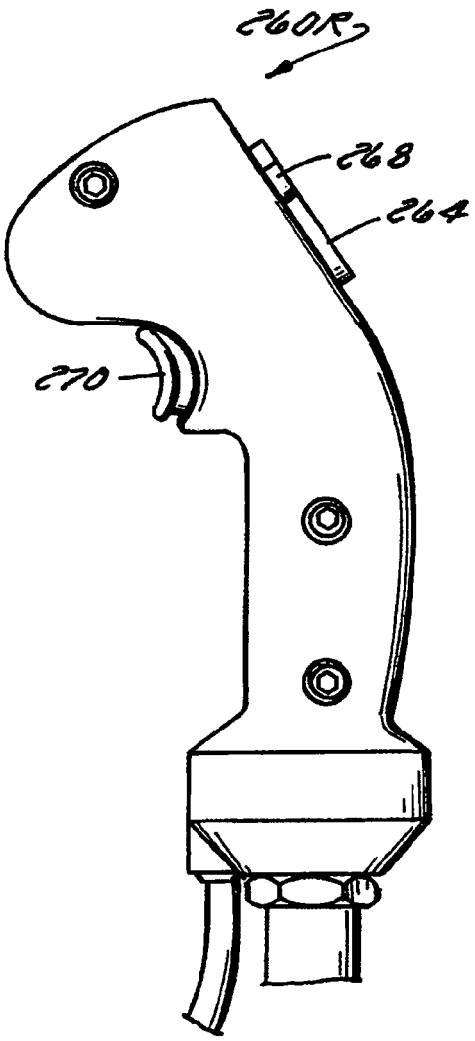

Referring to FIGS. 17 and 18, the joystick 260R is a two axis joystick moving fore and aft and side to side. It also has first and second toggle switches 262, 264 and first and second push button switches 266, 268 on its front surface and a trigger 270 on its back surface. Manipulation of these elements in the following manner results in the following operation:

- side to side motion of joystick 260R results in extension/retraction of cylinder 148 and pusher motion toward/away from the rail R;
- forward/reverse motion of joystick 260K results in extension/retraction of cylinder 168 and raising/lowering of the pusher;
- forward/reverse depression of toggle switch 262 extends/retracts the cylinder 155 to move the tie plate inserter assembly 44R forward/backward;
- forward/reverse depression of the toggle switch 264 extends/retracts cylinder 122 to extend/retract the jack 94;
- depression/release of push button switch 266 extends/retracts cylinder 155 to open/close the tie plate clamp assembly 198;
- depression/release of push button switch 266 and trigger 270 extends/retracts cylinder 100 to open/close the rail clamp 92;
- actuation of the trigger 270 on left joystick 260L and right joystick 260R initiates an auto-clamping and rail lifting operation, and release of both triggers 270 returns all components of the system to their "home" position.

The toggle switches 262 and 264 are proportional in nature such that each successive toggle moves the associated cylinder 155 and 122 an additional increment. Conversely, actuation of the push button switches 266 and 268 merely triggers an automatic operation such as complete cylinder retraction, complete cylinder extension and/or cylinder pressurization up to a preset limit. The triggers 270 can be actuated as an alternative to individually manipulating the switches 264 and 266. That is, by simultaneously actuating the triggers 270 and the push button switch 266, the rail clamping operation and rail lifting operation are performed automatically and sequentially without any other operator input. The operator holds the triggers 270 until the tie plates P are installed and then releases the triggers 270 to automatically retract the jack 94 and unclamp the rail R. The release of the triggers 270 also returns all cylinders to return the inserter assembly 44R to its retracted or home position. In this case, the jack extend switch 264 acts as an override switch that overrides the automatic operation initiated by the trigger to assure adequate jack extension should the jack 94 encounter an obstruction during the automatic operation.

Other controls, such as those required to actuate the cylinders 64 and 66 to raise and lower the workhead 28, while not shown, may comprise switches, levers, or any other suitable controls available to those skilled in the art.

The tie plate inserting machine 20 as described above operates as follows when used in tie replacement setting.

First, the operator transports the machine 20 to the worksite with the workhead 28 in its travel position due to the retraction of cylinders 64 and 66. Prior to this operation, laborers and/or one or more machines would have removed the old ties T from the railway, inserted the new ties T, and cleaned ballast or other debris from the top of the ties T. Importantly, and unlike with prior tie plate inserting machines, new or used tie plates P are also set on the ties T adjacent the field side of the rails R prior to insertion of the tie plate by the tie plate inserting machine 20. This setting may occur either well in advance or just ahead of operation of the tie plate inserting machine 20.

Upon arrival at the worksite, the operator extends the cylinders 64, 66 to lower the workhead 28 to its travel position in which the rollers 76 rest on top of the rails R. At this time, the cylinders 168, 148 are in positions in which the pusher is raised away from the tie T and is positioned well outboard of the field end of the tie plate P, and the tie plate clamp assembly 198 is open. Next, the operator stops the machine 20 in a position in which the workhead 28 is at least approximately centered over the tie T. This centering may be performed manually by inspection or with the assistance of sensors such as a laser-based sensor. At this time, the hard stop 230 is positioned inboard of the gauge side of the rail R in general alignment with the gauge end of the tie plate P. The spacing between the hard stop 230 and the rail R is set by suitable actuation of cylinder 254. However, as indicated above, this actuation is not performed on a cycle-by-cycle basis but, instead, is a "set and forget" function that sets the spacing for a given tie plate and tie configuration.

The operator then engages the triggers 270 of both joystick to first engage the associated rail clamp 92 and then extend the jack 94 to lift the rails R to the position seen in FIGS. 6-9. The operator then moves the joysticks 260 forward to lower the push plate 196 of each pusher 158 into the same vertical plane as the field end of the associated tie plate P. If necessary, the operator also engages the switch 262 to at least generally align the longitudinal centerline of the push plate 196 with the end of the tie plate P. It should be noted, however, that this operation might not be necessary in every instance. Both alignments may be performed either manually solely by inspection and/or with feedback from sensors and/or monitors (not shown).

Next, the operator moves each joystick 260 inboard to move the pusher 158 toward the associated tie plate P. If desired, the operator may operate the switch 266 to close the tie plate clamp assembly 198 as the push plate 196 approaches the field end of the tie plate P so as to accommodate a skewed tie plate P and/or a tie T that is tilted about its longitudinal center line. As indicated above, tie plate tilting is also accommodated by passive swinging of the pusher 158 about pin 186.

Next, the operator moves each joystick 260 inboard so that the push plate 196 first engages and then pushes to the associate tie plate P beneath the rail R until the gauge end of the tie plate contacts the pins 234 and 236 of the hard stop 230 to arrest further tie plate movement as seen in FIG. 9. The tie plate insertion process is now complete. If operating in "auto" mode, the operator need only release the triggers 270, and moves the joysticks to the neutral lateral position, and each tie plate inserter assembly 44L, 44R automatically returns to its home position, the jacks 94 are retracted to lower the rail R onto the tie plate P, and the rail clamps 92 are released. These operations may alternatively be performed manually by suitable manipulation of the joysticks and switches. The operator then drives the machine 20 to the next tie, where the sequence is repeated.

The process as described above is very reliable and can be performed very rapidly due to the fact that the insertion process is automatic, yet no complex dispensing and transport mechanisms need be activated to set a tie plate P adjacent the rail R. Indeed, experiences has shown the entire process, from engagement of the rail clamp, through tie plate insertion, and to release the rail clamp can be performed in under 10 seconds and, in fact, in as little as 5-7 seconds. This is a dramatic improvement over prior known machines.

As indicated above, many changes and modifications may be made to the present invention without departing from the spirit thereof. The scope of some of these changes is discussed above. The scope of others will become apparent from the appended claims.

We claim:

1. A tie plate inserting machine comprising:

a. a chassis;

b. wheels that support the chassis on a railway;

c. a workhead that is mounted on the chassis;

d. a tie plate inserter assembly that is mounted on the workhead and that includes a pusher that is driven by powered actuators to move vertically, longitudinally, and laterally relative to the workhead and the railway so as to be aligned with a stationary tie plate on a railroad tie and then push the tie plate beneath a rail.

2. The tie plate inserting machine as recited in claim 1, wherein the tie plate inserter assembly includes a frame that is mounted on the workhead and that is moveable laterally relative to the workhead and the railway, and wherein the pusher is mounted on the frame and is moveable both vertically and longitudinally relative to the frame and the railway.

3. A tie plate inserting machine comprising:

a. a chassis;

b. wheels that support the chassis on a railway;

c. a workhead that is mounted on the chassis;

d. a tie plate inserter assembly that includes a pusher that is driven by powered actuators to move vertically, longitudinally, and laterally relative to the railway so as to be aligned with a stationary tie plate on a railroad tie and then push the tie plate beneath a rail, wherein the tie plate inserter assembly includes a frame that is mounted on the workhead and that is moveable laterally relative to the workhead, wherein the pusher is mounted on the frame and is moveable both vertically and longitudinally relative to the frame, and wherein the pusher can also pivot relative to the frame about a horizontal axis extending laterally of the railway.

4. The tie plate inserting machine as recited in claim 2, wherein the pusher comprises a push plate that extends longitudinally relative to the railway and that selectively engages a field end of a tie plate, and a clamp that opens and closes longitudinally relative to the railway to selectively engage side edges of the tie plate.

5. The tie plate inserting machine as recited in claim 1, wherein the tie plate inserter assembly further comprises a hard stop that is mounted on the workhead on a gauge side of the rail and that serves as a backstop against which a gauge end of the tie plate is driven by the pusher.

6. The tie plate inserting machine as recited in claim 5, wherein the position of the hard stop is laterally adjustable relative to the rail to accommodate different-sized tie plates.

7. The tie plate inserting machine as recited in claim 1, further comprising a rail clamp and a jack which, in combination, grasp and lift the rail for insertion of the tie plate therebeneath.

8. The tie plate inserting machine as recited in claim 1, wherein the tie plate inserter assembly is a first tie plate inserter assembly, and further comprising a second tie plate inserter assembly mounted on the workhead opposite the first tie plate inserter assembly and operable to insert a tie plate beneath a second rail of the railway.

9. The tie plate inserting machine as recited in claim 1, wherein the workhead is movable vertically relative to the chassis from a lowered, operative position to a raised, traveling position.

10. The tie plate inserting machine as recited in claim 1, further comprising joystick-mounted controls that actuate the powered actuators.

11. A tie plate inserting machine comprising:

a. a chassis;

b. wheels that support the chassis on a railway;

c. a workhead that is mounted on the chassis; and d. a tie plate inserter assembly including i. a frame that is mounted on the workhead and that is moveable relative to the workhead laterally of the railway;

ii. a pusher that is mounted on the frame and that is moveable vertically and longitudinally relative to the frame and the railway, wherein the pusher comprises a push plate that extends longitudinally relative to the railway and that selectively engages a field end of a tie plate and pushes the tie plate beneath a rail of the railway longitudinally relative to the railway, and a clamp that opens and closes to selectively engage side edges of the tie plate, and iii. a hard stop that is mounted on the workhead on a gauge side of the rail and that serves as a backstop against which a gauge end of the tie plate is driven by the tie pusher.

12. A method of inserting a tie plate beneath a rail of a railway, comprising:

a. placing a tie plate on a tie outboard of a field side of a rail; then b. moving a tie plate inserting machine longitudinally along the railway to a position in which a pusher of the tie plate inserting machine is located in the vicinity of the tie plate, the tie plate inserting machine further including a chassis and a workhead that is supported on the chassis and that supports the pusher; then c. actuating power actuators to move the pusher vertically, laterally, and longitudinally relative to the workhead to drive the tie plate beneath the rail.

13. The method as recited in claim 12, wherein the actuating step comprises a. actuating a first actuator to drive the pusher longitudinally of the workhead to a position in which the pusher is at least generally aligned with a vertical plane bisecting a gauge end of the tie plate;

b. actuating a second actuator to drive the pusher vertically to a position in which the pusher is in vertical alignment with the gauge end of the tie plate; and c. actuating a third actuator to drive the pusher laterally of the railway to a position in which the pusher pushes the tie plate beneath the rail.

14. The method as recited in claim 13, wherein the actuating steps are performed by manually manipulating controls, and further comprising actuating a single control to automatically return at least the second and third actuators to home positions after the actuating steps are complete.

15. The method as recited in claim 14, wherein the actuating step comprises releasing a trigger.

16. The method as recited in claim 14, wherein the actuating step also triggers automatic retraction of a jack and release of a rail clamp.

17. The method as recited in claim 12, wherein the step of actuating the third actuator comprises driving the pusher to a position in which a gauge end of the tie plate engages a hard stop located inboard of the rail.

18. The method as recited in claim 12, wherein the step of placing the tie plate is performed manually.

19. The method as recited in claim 12, further comprising clamping the pusher onto the tie plate prior to pushing the tie plate beneath the rail.

20. A tie plate inserting machine comprising:

a. a chassis;

b. wheels that support the chassis on a railway;

c. a workhead that is mounted on the chassis;

d. a tie plate inserter assembly that includes a pusher that is driven by powered actuators to move vertically, longitudinally, and laterally relative to the chassis and the workhead so as to be aligned with a stationary tie plate on a railroad tie and then push the tie plate beneath a rail.

21. A tie plate inserting machine comprising:

a. a chassis;

b. wheels that support the chassis on a railway;

c. a workhead that is mounted on the chassis;

d. a tie plate inserter assembly that includes a pusher that is driven by powered actuators to move vertically, longitudinally, and laterally relative to the chassis and the workhead so as to be aligned with a stationary tie plate on a railroad tie and then push the tie plate beneath a rail, wherein the tie plate inserter assembly includes a frame that is mounted on the workhead and that is moveable relative to the workhead laterally of the railway, and wherein the pusher is mounted on the frame and is moveable, relative to the frame, both vertically and longitudinally relative to the workhead.

22. The tie plate inserting machine as recited in claim 21, wherein the pusher can also pivot relative to the frame about a horizontal axis extending laterally of the railway.

23. The tie plate inserting machine as recited in claim 20, wherein the workhead is movable vertically relative to the chassis from a lowered, operative position to a raised, traveling position.

24. The tie plate inserting machine as recited in claim 20, further comprising joystick-mounted controls that actuate the powered actuators.

25. The tie plate inserting machine as recited in claim 20, wherein the tie plate inserter assembly is further configured to be driven by powered actuators to move linearly relative to the chassis and the workhead.

26. A tie plate inserting machine comprising:

a. a chassis;

b. wheels that support the chassis on a railway;

c. a workhead that is mounted on the chassis;

d. a tie plate inserter assembly that is mounted on the workhead and that includes a pusher that is driven by powered actuators to move vertically, longitudinally, and laterally relative to the railway and the workhead so as to be aligned with a stationary tie plate on a railroad tie and then push the tie plate beneath a rail, wherein the tie plate inserter assembly is further configured to be driven by powered actuators to move linearly vertically and linearly longitudinally relative to the chassis.

* * * * *